US006330418B1

(12) United States Patent
Ahl et al.

(10) Patent No.: US 6,330,418 B1
(45) Date of Patent: Dec. 11, 2001

(54) SEGMENTED TRANSFER BLADE USING A ROTATING DECISION STOP

(75) Inventors: David K. Ahl, Rochester; Douglas Mckeown, Geneseo; Robert A. Gross; Youti Kuo, both of Penfield, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/653,857

(22) Filed: Sep. 1, 2000

(51) Int. Cl.[7] ..... G03G 15/16
(52) U.S. Cl. ..... 399/311; 399/316; 399/317
(58) Field of Search ..... 399/297, 310, 399/311, 312, 314, 316–318

(56) References Cited

U.S. PATENT DOCUMENTS 5,227,852 7/1993 Smith et al. .
5,247,335 9/1993 Smith et al. .
5,321,477 * 6/1994 Nagata et al. ..... 399/312
5,539,508 * 7/1996 Piotrowski et al. ..... 399/170
5,568,238 * 10/1996 Osbourne et al. ..... 399/311
5,923,921 * 7/1999 OuYang et al. ..... 399/317 X

* cited by examiner

*Primary Examiner*—William J. Royer
(74) *Attorney, Agent, or Firm*—Perman & Green, LLP

(57) ABSTRACT

A device and method of enhancing contact between a photoconductive member of a electrophotographic printing machine and the paper to which an electrostatic latent image is to be transferred uses an array of wiper blade segments mounted on a common shaft. Each segment is attached to the shaft for limited rotational movement on the shaft in opposition to a torsion spring. The torsion spring biases the blade segment towards the paper. Some of the blade segments are operatively associated with a stop mechanism to control the length of the wiper blade array in accordance with the size of the paper being processed. The stop mechanism prevents movement of the blade segment into engagement with the paper by restraining movement of the segment against its torsion spring.

11 Claims, 7 Drawing Sheets

SEGMENTED TRANSFER BLADE USING A ROTATING DECISION STOP

BACKGROUND OF THE INVENTION

The invention relates generally to a color or monochrome electronic reprographic printing system, and more particularly concerns apparatus for optimizing the contact between paper or other copy media and a photoconductive surface.

In an electrophotographic printing machine, a photoconductive member (often a photoreceptor belt) is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is treated with toner particles and is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated in a plurality of cycles for differently colored images and their respective complementarily colored toner. Each single color toner image is transferred to the copy sheet in superimposed registration with the prior toner image. Alternately, a plurality of images may be superimposed on the photoreceptor surface, and transferred simultaneously to the sheet. This creates a multi-layered toner image on the copy sheet. Thereafter, the multi-layered toner image is permanently affixed to the copy sheet creating a color copy. The developer material may be a liquid or a powder material.

Surface irregularities in the paper may occur prior to use or during handling. Such irregularities are often caused by exposure to moisture, mishandling, duplexing, etc and create localized deformities in the copy paper. As a result, air gaps may form between the paper and the photoreceptor belt. Such gaps result in poor transfer of toner from the belt to the paper, which may, in turn, cause deletions or distortions in the printed copy. Flipping the paper over, or discarding the old paper and adding fresh paper offer possible solutions to this problem, but require the labor of frequent monitoring. The resulting rotation of paper stock is inherently expensive in paper costs, labor, and down time. Therefore, a means for reducing the need for operator involvement and reducing the amount of paper that is wasted is needed.

A device which applies a force against the back of a sheet and flattens it against the photoreceptor belt is one possible solution to the problem. U.S. Pat. No. 5,247,335, owned by Xerox Corp., describes a machine having such a device. The device described in the '335 patent employs a cam to move a wiper blade against the copy paper to facilitate engagement of the paper and photoreceptor belt.

Another Xerox Corporation patent, U.S. Pat. No. 5,227,852, describes another embodiment of a wiper blade which uses four flexible blade segments, each of which is deflected back away from the photoreceptor belt by solenoid actuated mechanisms. One or more of the solenoids are activated by the passage of a sheet, depending on the paper size being used. Since the blades of these machines are held in a deflected-back state both during standby and between each copy, the blade may tend to take on a permanent set over time, decreasing the force applied. This may result in the degradation in performance, over time, of the blades, and the need to replace the blades frequently.

There remains a need for a device that will provide enhanced contact between a copy sheet and a photoreceptor belt that is reliable and requires little maintenance.

SUMMARY OF THE INVENTION

In the method and apparatus of this invention, a series of wiper blades are provided which are mounted on a common shaft and are spring biased against the paper in operation. The wiper blades are operated individually or in pairs by steeping motors which drive a linkage system to rotate the blades into and out of engagement with the paper. The blades pivot about a common pivot rod which is mounted transverse to the path of the paper. Each blade is equipped with an additional elastic plastic contact edge that is less rigid than the body of the supporting blade segment.

Each blade is fixed to the rod for rotation therewith through a torque spring. The torque spring allows the blade to pivot on the rod through a limited arc of motion. The pivot motion of the blades on the rod is biased by the torque spring towards engagement with the paper. The torque spring thereby provides a gradual and consistent loading of the paper to provide accurate and effective toner transfer when the blades are rotated into engagement.

The actuation mechanism of the blades involves a lever and crank assembly which applies a stepped rotation of a stepping motor to rotate the blades between two positions. All of the blades operate on the same rod and are actuated simultaneously towards and away from engagement with the paper. Depending on the size of the paper, all of the blades may not be necessary to apply uniform pressure to the paper. In order to avoid contamination of the wiper blades with toner and wear to the photoconductor element, a mechanism is needed to select the combination of blades suitable for the particular size paper in process. Accordingly, each of the blades is operatively associated with a decision stop which may be constructed as a cam sector. The cam sector engages a pawl shaped extension on the blade assembly to selectively limit movement of a selected blade against the paper. As the blade rod rotates, the cam sector holds the engaged blade assembly against the torque spring, while the rod continues to rotate to engage the unrestrained blades into contact with the paper. The blade array may consist of multiple pairs of outboard blades and a single central inboard blade to service paper in the required range of sheet widths. In a center registered configuration only the outboard blades would be associated with a stop mechanism. Alternately, the blade array may consist of a single outboard blade and a plurality of inboard blades. In this edge-registered configuration, only the inboard blades would be associated with a stop mechanism.

The cam sector is mounted on a second shaft which is driven by a second stepping motor. The second stepping motor rotates the cam sector between positions which provide the desired range of restraint to the associated blade assembly. The stop stepping motor is controlled by sensors that monitor the size of the paper as it passes through the copier. A separate control actuates the blade motor in response to a sensor which senses the leading edge of the paper prior to its arrival at the photoconductive element. The timing of the stepping motors and their motion may be determined by reference to a table of electronically stored actuation and deactuation timing values. These values are referenced to data regarding blade mechanism position which is acquired from sensors within the blade mechanism, and sheet position, which is acquired either from sensors within the blade mechanism or elsewhere in the paper path.

The invention offers the following advantages:

A large, if not limitless, number of sheet sizes may be accommodated by only two driving members (motors). Previous designs required one driving member for each size accommodated.

A flexible blade tip provides a gentle application of the load and prevents the image from being disturbed when the blade touches down.

The flexible tip also conforms to the photoreceptor belt position, thereby providing a uniform pressure to the sheet, despite tolerances in its alignment to the surface of the belt.

A spring loaded blade support provides a more consistent applied load.

Selecting the blade segment for restraint rather than actuation, simplifies the mechanism and the adjustment of the blade system to multiple paper sizes.

The use of stepping motors as the driving mechanism provides an accurate and easily controllable motion.

DESCRIPTION OF THE DRAWING

The invention is described in more detail below with reference to the attached drawings in which.

DETAILED DESCRIPTION OF THE INVENTION

Figure 1A:
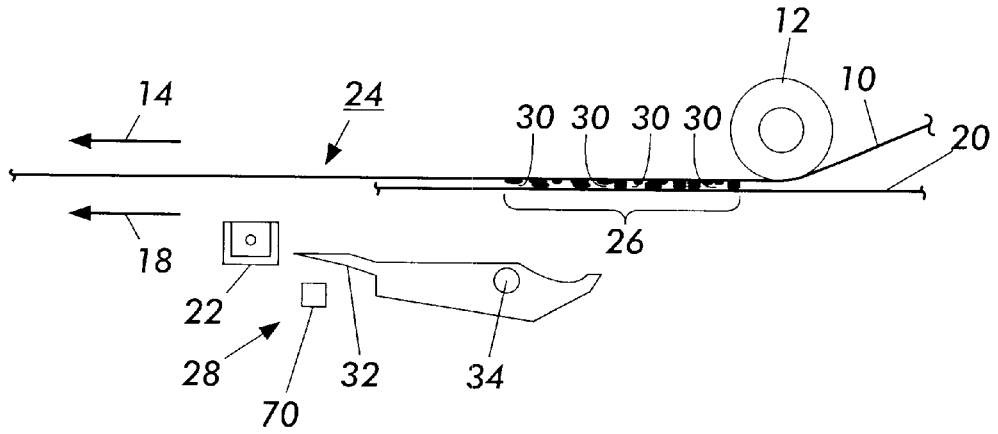
FIGS. 1*a* and 1*b* are schematic illustrations of a copier system employing contact enhancement.
Figure 1B:
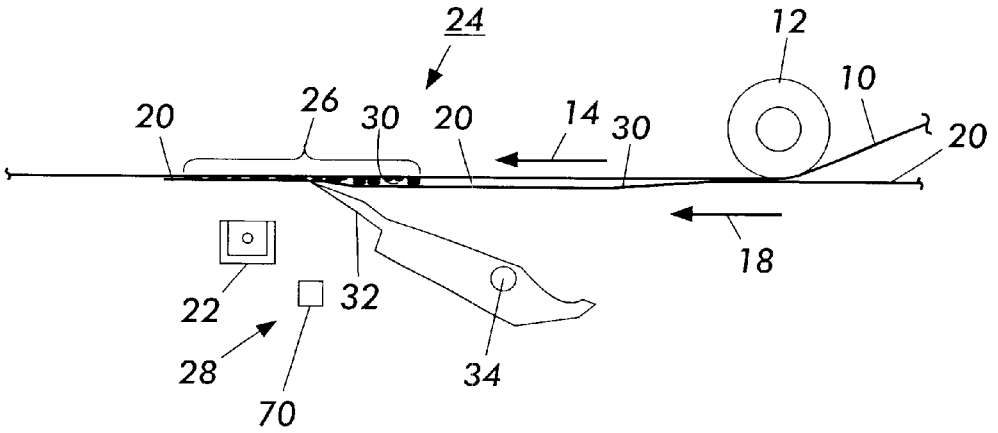

FIGS. 1*a* and 1*b* illustrate the general arrangement of a contact enhancing mechanism 28. The photoconductive member is entrained about a plurality of rollers (only one roller 12 is shown). The photoconductive member 10 is advanced in the direction of arrow 14 in a recirculating path of movement with a developed image (or toner image) 26 electrostatically secured thereto. A sheet 20 is electrostatically attracted to the photoconductive member 10 and is drawn in the direction of arrow 18. FIGS. 1*a* and 1*b* further show the developed image 26 interposed between the advancing photoconductive member 10 and the advancing sheet 20. Photoconductive member 10 could take the form of a belt in some systems or a drum in others without appreciably altering the function of this invention.

The contact enhancing mechanism 28 functions to enhance contact between the sheet 20 and the developed image 26 so as to improve the quality of transfer of the developed image 26 from the photoconductive member 10 to the sheet 20. The contact enhancing mechanism 28 includes a blade 32 which is pivotable on a rotatable rod 34. A single sensor 70 is shown to monitor the position of the blade 32. Depending on the application, it may be desirable to use multiple sensors to detect the various positions of the parts of the mechanism 28.

FIGS. 1*a* and 1*b* depict the movement of the sheet 20 as it is transported, by the electrostatic attraction, through the transfer zone 24. More specifically, FIG. 1*a* shows sheet 20 just prior to passing over the contact enhancing mechanism 28. Without a contact enhancing mechanism, a number of gaps 30 between the sheet 20 and the developed image 26 may develop. The gaps 30 define areas of poor contact between the sheet and the developed image. These areas of poor contact may hinder the transfer of developed image 26 from the photoconductive member 10 to the sheet 20. With continued advancement of the sheet 20, a timed signal triggers the actuation of the enhancing mechanism 28 to pivot the blade 32 on the rotatable rod 34 from its position shown in FIG. 1*a* to its position shown in FIG. 1*b*. The blade 32 contacts the sheet 20 so as to cause the sheet to be urged toward and into contact with the developed image 26, as shown in FIG. 1*b*, thereby reducing the undesirable presence of gaps 30. This signal may be timed based on the paper length run as detected in the paper tray.

As a result, contact between the sheet and the developed image is enhanced as successive portions of the sheet are advanced by and in contact with the blade 32. With further advancement, the sheet passes over the corona generating device 22. The corona generating device establishes a transfer field that is effective to attract the developed image from the photoconductive member 10 to the sheet 20. The contact enhancing mechanism, in response to a second timed signal, pivots the blade 32 on the rotatable rod 34 from its position shown in FIG. 1*b* back to its position shown in FIG. 1*a*.

Figure 2:
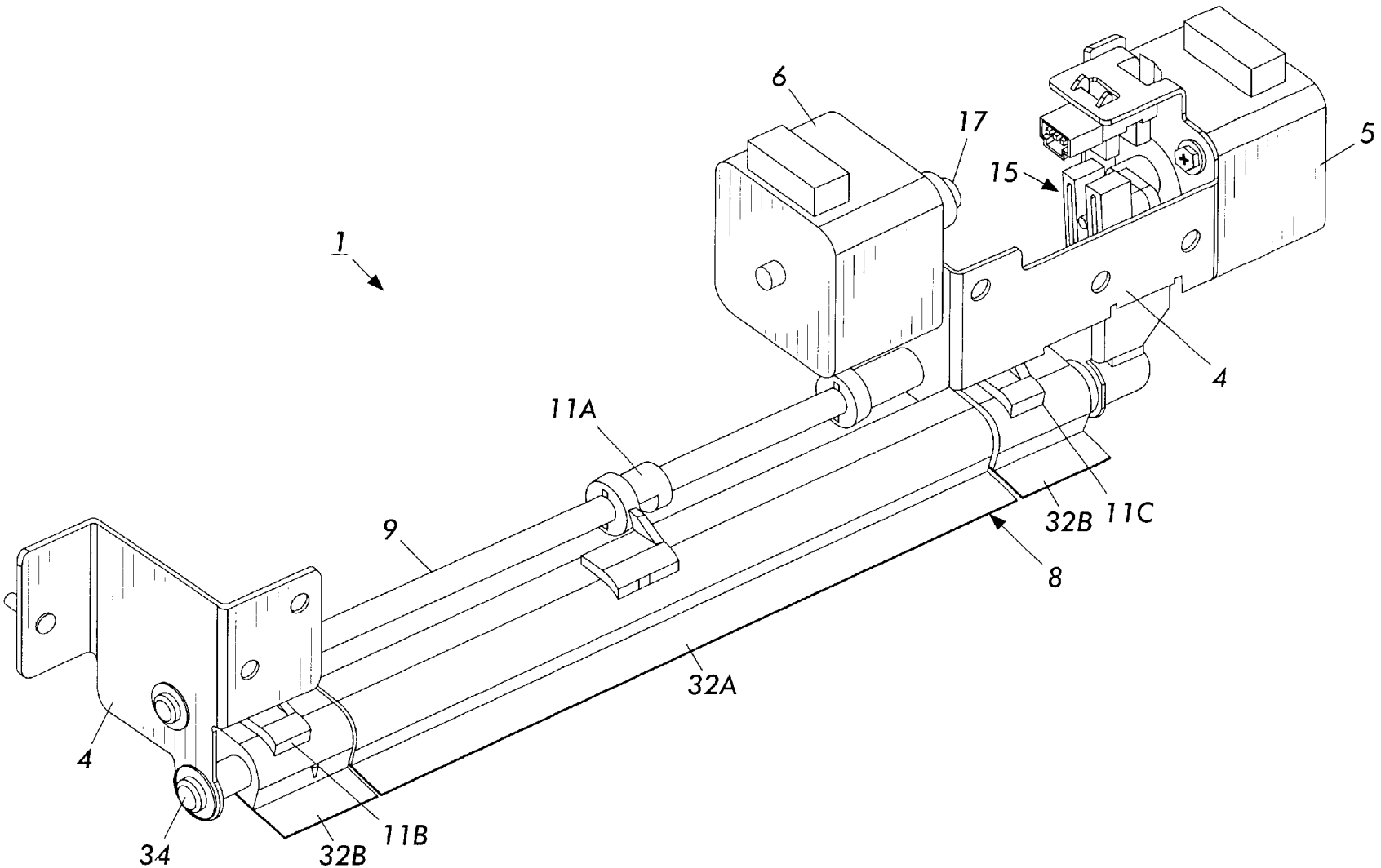
FIG. 2 is a perspective view of the blade wiper assembly.

An actuation and support assembly 1 for wiper blade 32 is shown in FIG. 2. Assembly 1 is constructed with mounting brackets 4 for installation in a copier machine (not shown). Stepping motors 5 and 6 are fixed on brackets 4. Motor 5 drives blade pivot rod 34, as shown in FIG. 2, on which is mounted an array of wiper blades 8. Motor 6 drives rod 9 on which is mounted decision stops 11*a*, 11*b*, and 11*c*. Motor 5 is connected to rod 34 through a crank and lever assembly 15 and motor 6 is connected to rod 9 by a gear system 17. As an alternative, a single motor may be used which is connected to the rods 9 and 34 through appropriate clutches which allow rotation of one of the rods while the other slips.

For the purpose of illustration, wiper blades 8 are constructed of multiple blade segments 32. In particular, to allow adjustment to accommodate different sized paper, there is a central blade segment 32*a* and a pair of outboard segments 32*b*. As shown in FIG. 2, each of the blade segments 32*a* and 32*b* are independently mounted on the pivot rod 34 for rotation therewith. Each of the blade segments 32 are connected to the rod 34 by means of torsion springs 7. The springs 7 are constructed and attached between the rod 34 and the respective blade segments 32 to generate a torque on the blade segments 32 that tends to rotate the blade segment towards the paper. In this manner a limited rotation of the blade segments 32 is permitted on the pivot rod 34 against the torsion spring 7, otherwise the blade segments 32 move with the pivot rod 34.

Figure 6:
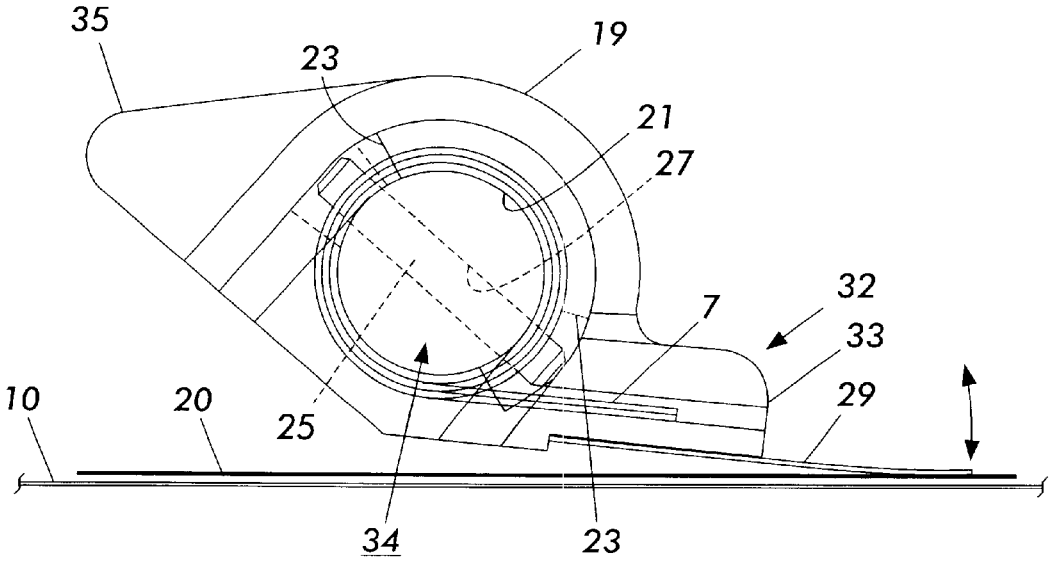
FIG. 6 is an end view of the blade assembly.
Figure 7:
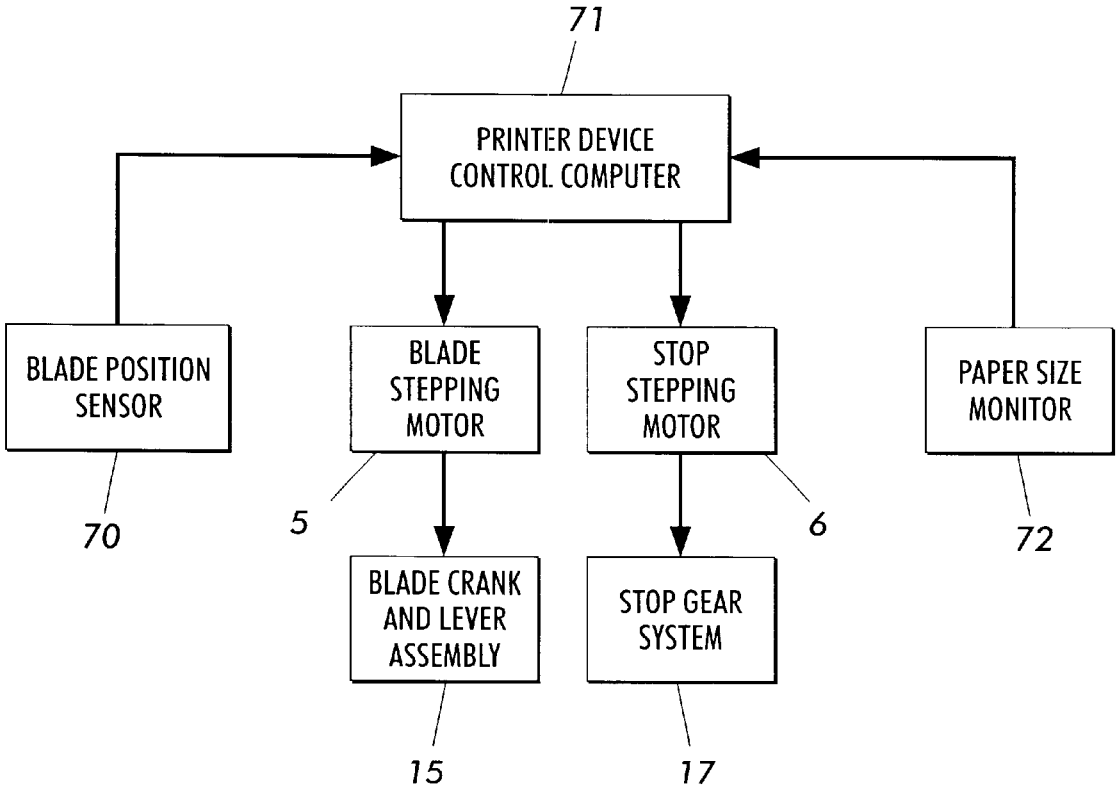
FIG. 7 is a block diagram of the control system for operation of the blade system.

As shown in more detail in FIG. 6, each blade segment 32 consists of a body 19 having a central bore 21. Body 19 includes a blade edge holder portion 33 and a pawl shaped extension portion 35. The bore 21 is constructed with opposing key slots 23. The blade segment 32 is fitted onto the pivot rod 34 through the bore 21. Pin 25 is inserted through a transverse passage 27 to seat within the key slots 23. Key slots 23 are arcuate segments which allow a limited range of movement of the blade segment 32 on the rod 34. The key slots in the blade holder allows the blade to rotate with respect to the pivot rod in the direction away from the photoreceptor belt and sheet. The sheet 20 is pressured into engagement with photoconductive member 10 by a force exerted by blade edge 29 which may be constructed of a flexible sheet material. Blade edge 29 is mounted on blade edge holder portion 33 and extends outward to form an engaging surface for contact with sheet 20.

Figure 3:
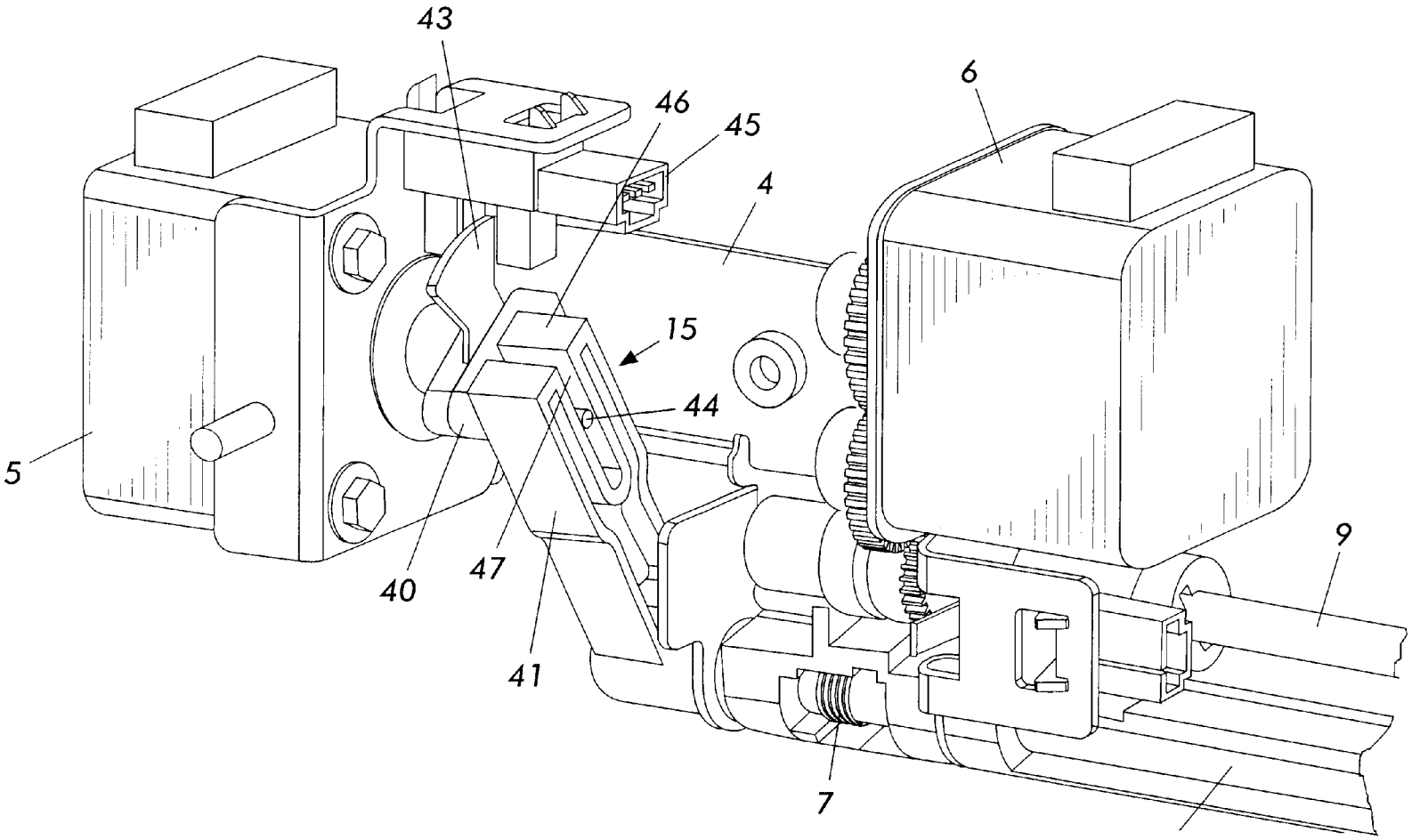
FIG. 3 is a perspective view of the blade wiper assembly showing the blade actuation mechanism.
Figure 4:
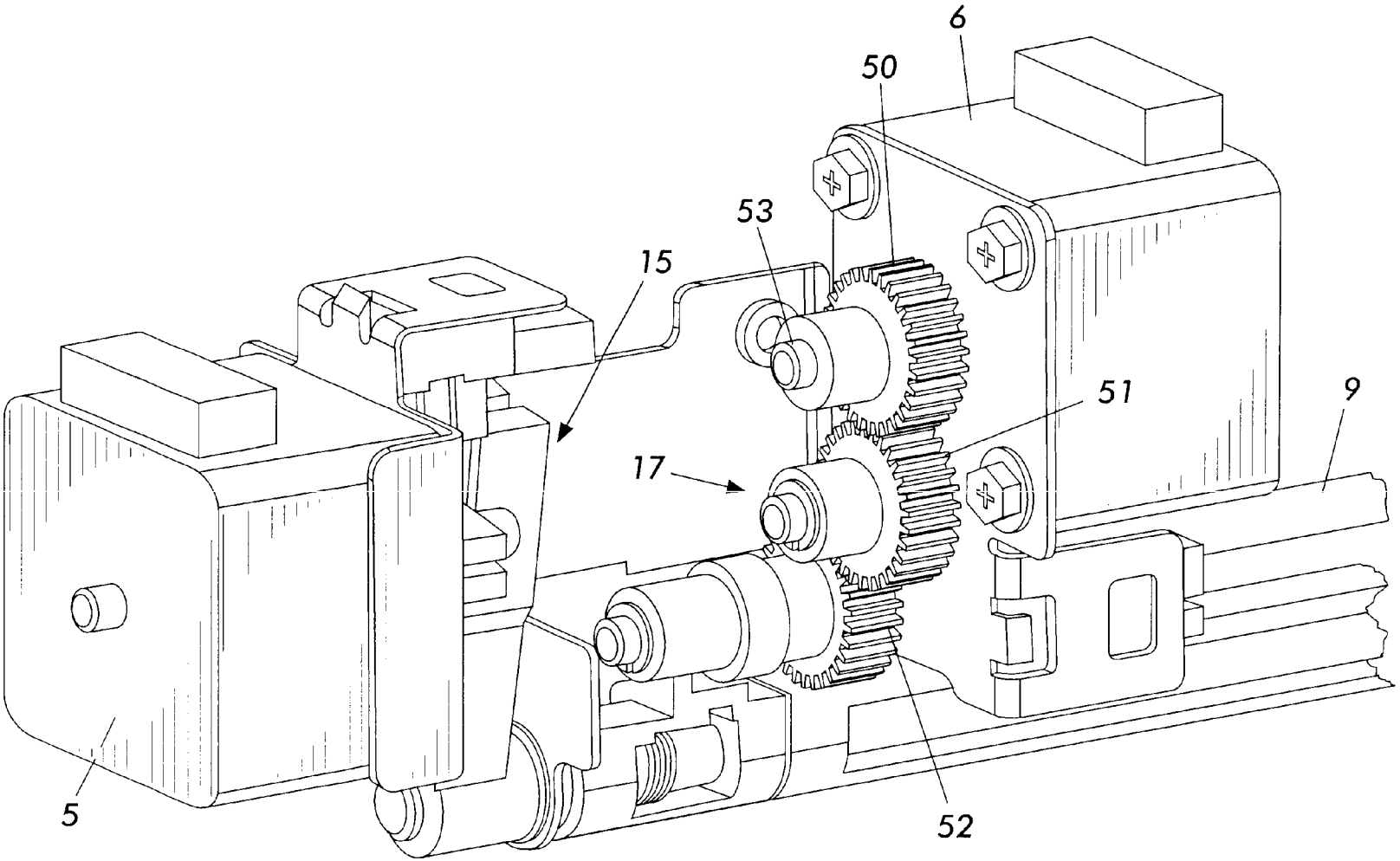
FIG. 4 is a perspective view of the blade wiper assembly showing the decision stop actuation mechanism.
Figure 5A:
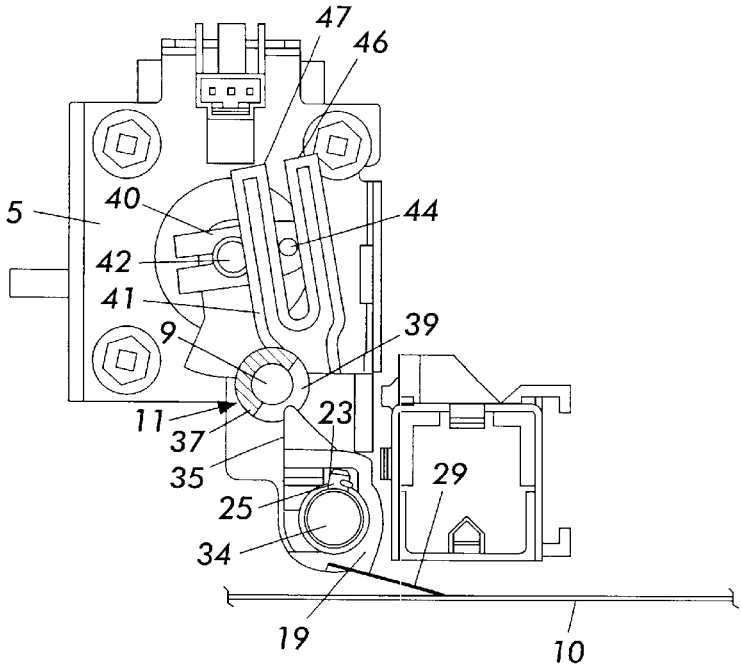
FIGS. 5*a* and 5*b* are end views of the blade wiper actuation mechanism in the engaged and disengaged positions respectively.
Figure 5B:
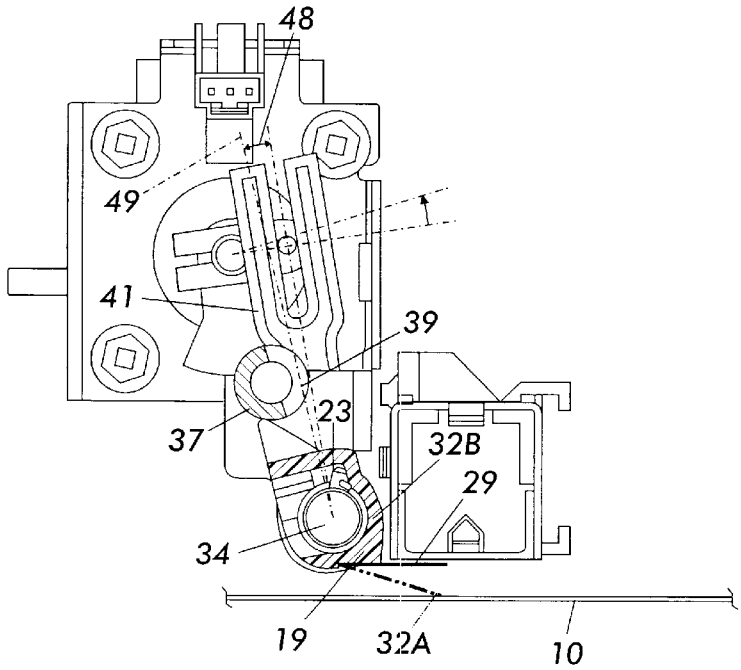

Pivot rod 34 is driven by stepping motor 5 through a crank and lever assembly shown at 15 in FIG. 2 and FIG. 3. Crank and lever assembly 15 is an operatively associated assembly of a crank 40 and lever 41. Crank 40 is fixed for rotation on drive shaft 42 of stepping motor 5 and is constructed having a body which extends radially outward from the shaft 42. A pin 44 is fixed transversely to the crank 40 in a position which is displaced radially outward from the axis of rotation of the shaft 42. Lever 41 is fixed to pivot rod 34 to transmit rotary motion of drive shaft 42 to the rod 34. Lever 41 is constructed having an elongated body which extends to meet crank 40. The outer end 46 of lever 41 is constructed with a longitudinal slot 47 extending partially down the lever 41. Slot 47 engages pin 44 allowing pin 44 to freely move within slot 47. As shown in FIGS. 5*a* and 5*b*, crank 40 is in the position in which the blade edges 29 of the blade segments 32*a* and 32*b* are in contact with the sheet on member 10. As crank 40 rotates counterclockwise with drive shaft 42 to a new position 49, as shown in FIG. 5*b*, pin 44 will pivot lever 41 through an angle 48. In this position the blades are disengaged. Blade position may be monitored by a sensor 45 which generates a signal triggered by flag 43 mounted on the crank 40.

As shown in FIGS. 5*a* and 5*b*, because of the limited range of movement allowed by the mounting arrangement of the blade body 19 to the pivot rod 34, the force exerted by the blade edge 29 is dependent on the spring constants of the torsion spring 7. Torsion spring 7 is fixed between pivot rod 34 and blade body 19.

Because of the varied size of paper 20 processed by the copier device, the length of the wiper blades 8 must be adjustable. As previously stated, the blades 8 consist of inboard central blade segment 32a and a pair of outboard blade segments 32*b*. It should be noted that any combination of segments may be used to accommodate the degree of adjustment required by the particular application. For this purpose, each of the blade segments 32 are operatively associated with a decision stops 11*a*, 11*b*, or 11*c*. The decision stops 11 are constructed with a cam sector 37 and an open sector 39. Decision stops 11*a*, 11*b*, and 11*c* are mounted on a common rod 9 for rotation therewith. Rod 9 is driven by stepping motor 6 through a gear system 17 consisting of a drive gear 50 connected to drive shaft 53, a transmission gear 51 and a driven gear 52 attached to rod 9.

In operation, in response to a signal from, for example, a paper size monitor 72 within the paper tray of the copier system, a decision stop signal is generated by the control computer 71 to operate the decision stop 11. If for example the paper size indicator 72 reflects the most narrow width, only the inboard blade segment 32*a* is needed. As shown in FIG. 5*b*, when the cam sector 37 engages the pawl 35 of the blade body 19, it restrains movement of the blade segments 32*b* against the torsion spring 7. When paper having a larger width is detected, the decision stop is rotated so that the open sector 39 aligns with the pall 35 and the blade segment 32*b* is allowed to rotate with blade segment 32*a*, as shown in FIG. 5*a*.

Movement of decision stop 11 is accomplished by stepping motor 6 which moves through a series of steps that rotate the cam sector 37 or open sector 39 into engagement with the pawl 35 to adjust the position of blade segments 32*b*, i.e. restrained or unrestrained.

In response to another timed signal generated by sensors in the system, for example upon the entrance of the leading edge of the sheet 20 into the transfer zone, stepping motor 5 receives a signal from control computer 71 to pivot the blade segment 32 into engagement with the sheet 20. Stepping motor 5 rotates pivot rod 34 through a programmed series of stepped increments at which the edge 29 of the blade segment 32 engages the sheet 20. It should be noted that this movement will move all of the blade segments 32*a* and 32*b* towards the sheet 20 unless one or more of the stops 11*a*, 11*b*, or 11*c* is engaged.

In this manner, a simple and precise mechanism is provided to adjust the width of the contact enhancing assembly. This prevents contact of the edge 29 with the photoconductive member, thereby avoiding blade contamination and damage to the member. Significantly, the contact enhancing mechanism 28 operates with only two motors to drive the elements of the mechanism 28.

What is claimed is:

1. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element comprising:

a wiper assembly mounted on the printing machine extending transverse to the direction of paper movement, said assembly comprising a plurality of blade segments mounted on a common pivot rod for pivotal motion with said pivot rod into engagement with said paper to force said paper against said blade segments, wherein each of said blade segments is independently mounted to the pivot rod through a torsion spring for limited rotational motion relative to said pivot rod;

a first drive connected to said pivot rod to rotate the rod about its longitudinal axis and thereby move said blade segments into engagement with the paper;

a stop mechanism operatively associated with at least one of said blade segments to selectively engage the blade segment to restrain motion of the blade on the pivot rod in opposition to the torsion spring and thereby preventing engagement of the selected blade segment with the paper; and a second drive connected to said stop mechanism to move said stop mechanism into engagement with the selected blade segment.

2. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element, as described in claim 1, wherein the blade segments are sized and arranged to provide multiple configurations according to the size of the paper being processed.

3. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element, as described in claim 2, further comprising a controller which selects said at least one blade segment in accordance with the size of the paper.

4. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element, as described in claim 1, wherein said first drive is actuated in response to the initiation of said paper into transfer engagement with said photoconductive element.

5. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element, as described in claim 1, further comprising a control system comprising:

a first sensor positioned in the path of the paper to sense the approach of said paper into transfer engagement with said photoconductive element and generate a signal in response thereto;

a second sensor positioned to monitor the size of the paper being processed and to generate a signal indicative of said size; and a processor connected to receive said signals from said first and second sensors and to actuate said first and second drives in accordance therewith, wherein said first drive is actuated to move the blade segments into engagement with the paper in response to the signal from the first sensor and wherein said second drive is actuated to move the stop mechanism into restraining engagement with the selected blade segment in accordance with the signal from the second sensor to adjust the configuration of the blade segments to the paper size.

6. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element, as described in claim 1, wherein said first drive is a stepping motor.

7. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element, as described in claim 1, wherein said second drive is a stepping motor.

8. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element, as described in claim 1, wherein the stop mechanism comprises:

a cam sector mounted on a shaft for rotation therewith between first and second positions;

a pawl member extending from said blade segment to engage the cam sector; and wherein the cam sector in the first position releases the pawl member to allow full rotation of said blade segment into engagement with said paper and, in the second position engages the pawl member to restrain the blade segment against said torsion spring to prevent engagement with said paper.

9. In an electrophotographic printing machine in which a charged photoconductive element is used as a printing medium, said photoconductive element having an electrostatic latent image exposed thereon and including means to transfer said latent image to paper by engaging said paper to said photoconductive element, a mechanism for enhancing the contact between said paper and said photoconductive element, as described in claim 1, wherein said first and second drives comprises a drive motor connected to said pivot rod and said stop mechanism by means of clutches which allow the independent positioning of said pivot rod and said stop mechanism.

10. In an electrophotographic printing machine in which a charged photoconductive element is used as a printing medium, said photoconductive element having an electrostatic latent image exposed thereon and including means to transfer said latent image to paper by engaging said paper to said photoconductive element, a method for enhancing the contact between said paper and said photoconductive element comprising the steps of:

constructing a blade assembly having a plurality of blade segments;

mounting said blade segments on a common pivot rod for pivot motion therewith, said pivot rod positioned in a paper path transverse to the direction of paper travel;

connecting said blade segments to said pivot rod by means of a torsion spring to allow limited motion of each blade segment on said pivot rod, said torsion spring biasing said blade segment towards engagement with said paper;

pivoting said pivot rod to engage the blade segments with said paper to force said paper against said photoconductive element;

selectively restraining at least one of said blade segments to prevent engagement of the selected blade segment with the paper, wherein said unrestrained segments are consistent with the size of said paper.

11. In an electrophotographic printing machine in which a charged photoconductive element is used as a printing medium, said photoconductive element having an electrostatic latent image exposed thereon and including means to transfer said latent image to paper by engaging said paper to said photoconductive element, a method for enhancing the contact between said paper and said photoconductive element, as described in claim 9, further comprising the steps of:

sensing the approach of said paper into transfer engagement with said photoconductive element and generating a first signal in response thereto;

monitoring the size of the paper being processed and generating a second signal indicative of said size;

processing said first signal to initiate pivoting of the pivot rod to engage the blade assembly with said paper in response to said signal;

processing said second signal to initiate selectively restraining at least one of said blade segments to prevent engagement of the selected blade segment with the paper, in accordance with said second signal.

* * * * *